United States Patent [19]

Thrower

[11] Patent Number: 4,597,514

[45] Date of Patent: Jul. 1, 1986

[54] SLIDING GATE VALVES AND COMPONENTS THEREOF

[75] Inventor: Anthony Thrower, Dronfield Woodhouse, England

[73] Assignee: USS Engineers and Consultants, Inc., Pittsburgh, PA

[21] Appl. No.: 546,022

[22] Filed: Oct. 27, 1983

Related U.S. Application Data

[63] Continuation-in-part of Ser. No. 478,382, Mar. 24, 1983, abandoned.

[30] Foreign Application Priority Data

| | | | |
|---|---|---|---|
| Mar. 29, 1983 | [DK] | Denmark | 1445/83 |
| Mar. 30, 1983 | [BR] | Brazil | PI8301641[U] |
| Mar. 31, 1983 | [AU] | Australia | 13123/83 |
| Mar. 31, 1983 | [CA] | Canada | 425077 |
| Mar. 31, 1983 | [EP] | European Pat. Off. | 83103248.7 |
| Mar. 31, 1983 | [KR] | Rep. of Korea | 1335/83 |
| Apr. 1, 1983 | [CN] | China | 7211011 |
| Apr. 1, 1983 | [HU] | Hungary | 1139/83 |
| Apr. 1, 1983 | [JP] | Japan | 58-55363 |
| Apr. 1, 1983 | [GB] | United Kingdom | 8209663 |

[51] Int. Cl.[4] ..... B22D 37/00

[52] U.S. Cl. ..... 222/600; 29/402.08

[58] Field of Search ..... 222/597, 598, 599, 600, 222/606, 607, 591; 164/337, 437; 29/402.03, 402.06, 402.08, 402.11, 402.09; 266/286, 281, 282, 285

[56] References Cited

U.S. PATENT DOCUMENTS

| | | | |
|---|---|---|---|
| 3,685,707 | 8/1972 | Shapland | 222/600 |
| 3,970,283 | 7/1976 | Hind | 222/600 |
| 4,179,046 | 12/1979 | Jeschke et al. | 222/600 |
| 4,376,501 | 3/1983 | Hafner et al. | 222/600 |
| 4,434,540 | 3/1984 | Capelli | 29/402.11 |
| 4,445,262 | 5/1984 | Capelli | 164/437 |

FOREIGN PATENT DOCUMENTS

| | | | |
|---|---|---|---|
| 1358327 | 7/1974 | United Kingdom . | |
| 1590775 | 6/1981 | United Kingdom . | |
| 2065278 | 6/1981 | United Kingdom | 222/600 |
| 2065850 | 7/1981 | United Kingdom . | |

*Primary Examiner*—Joseph J. Rolla
*Assistant Examiner*—Louise A. Heim
*Attorney, Agent, or Firm*—John F. Carney

[57] ABSTRACT

Gates for sliding gate valves in which refractory elements are cemented within metal enclosure trays include an inner refractory member that contains the metal pour opening and an outer refractory member that surrounds the inner member. Only the inner member in each gate is designed to be contacted in service by molten metal and is replaceably secured in the tray which have apertures for access of tooling used to displace the inner member out of the tray when replacement of the member is required.

4 Claims, 8 Drawing Figures

SLIDING GATE VALVES AND COMPONENTS THEREOF

This application is a continuation-in-part of U.S. Patent Application Ser. No. 478,382, filed Mar. 24, 1983, now abandoned.

BACKGROUND OF THE INVENTION

The present invention relates to sliding gate valves and components thereof, for use in the pouring of molten metals, and more particularly to their refractory valve plates such as their sliding plates.

The very aggressive conditions to which such valves and their valve plates are exposed when pouring molten metal are recognised to be detrimental to the plates. Despite the use of high-grade, costly refractory materials e.g. high in alumina, valve plates may have to be scrapped after only a few complete pours, or emptyings of a ladle used in supplying metal in a continuous casting plant. Thermal shock is one contributor to damage of valve plates when valves are opened and closed. Another contributor is chemical attack or erosion by metal flowing through the valve. Degradation of valve plates is accelerated when their valves are operated in throttling modes in controlled teeming.

Degradation is usually most marked in sliding valve plates of two-plate valves, and occurs also in the stationary lower plates of three-plate valves. Stationary upper valve plates are not entirely free from degradation either.

Use of refractories better able to resist the adverse service conditions might appear to be one solution. However, even the use of such materials as zirconia might only lead to modest improvements in service life. Routine use of such expensive materials is not cost-effective.

We have recognised that degradation of valve plates is confined largely to areas around or related to their flow orifices and the direction of motion of the sliding plate. From this recognition we have devised a plate construction which may reduce costs involved in scrapping and which facilitates renovation of valve plates.

SUMMARY OF THE INVENTION

According to the present invention, there is provided a valve plate for a sliding gate valve used in the pouring of molten metals, comprising an apertured metal tray having an orificed refractory plate member bedded therein on a layer of cement, the plate member being a composite structure formed by coplanar first and second interfitting refractory components, the first being inset in the second within a receiving opening provided therefor in the latter and the first component, which is an elongated or circularly-shaped element, having an orifice juxtaposed with the tray aperture, the tray further having one or more holes in its base beneath the first component which provide access for tooling to thrust upwardly on the first component for detaching it from the tray.

The invention comprehends a sliding gate valve when fitted with such a valve plate.

Valve plates according to the invention can be designed to suit both linearly and rotationally operated valves. In the former, the first component will be an elongated member having the orifice at one end or at the middle thereof. For a semi-rotary gate valve, wherein valve operation involves to and fro movement of the sliding plate through less than 360° about a sliding plate turning axis, the first component is arcuate or kidney-shaped, which term embraces a segment of an annulus. For rotary valves wherein sliding plate movement is through 360° (for instance to allow differently sized orifices to be brought into use), the first component will generally be a circular disc or annulus containing the orifices; the metal tray will, of course, have apertures equal in number to the orifices.

When the valve plate is integral with a pouring nozzle, the first component and nozzle will preferably mate by way of an interfitting connection or joint. Advantageously, the joint will be such that a downward protrusion from the first component serves as a protective liner for the vulnerable upstream end of the nozzle bore.

BRIEF DESCRIPTION OF THE DRAWINGS

The invention will be described in more detail by way of example only with reference to the accompanying drawings, in which.

DESCRIPTION OF A PREFERRED EMBODIMENT OF THE INVENTION

Sliding plate valves to which this invention is applicable are well known in the art and will not be discussed here in detail. A two-plate linearly-operated valve is disclosed, for instance, in G.B. No. 2,065,850 A. A similarly-operated three-plate valve is shown in B.P. No. 1,590,775. In these valves the sliding members are reciprocated to open and close the valves to flow. Another type of sliding gate valve to which the invention is applicable is the shove-through valve, wherein perforate or imperforate sliding plates are successively shoved into the teeming axis of the valve to open and close the valve.

The invention is also applicable to rotary and semi-rotary sliding gate valves. In the former, rotation is possible through 360° and in the latter rotation is through a lesser angle, for instance 90° or so. In such a semi-rotary valve, opening and closing is accomplished by to and fro swinging movements of the sliding plate in its plane. An exemplary rotary gate valve possessing freedom for forward and reverse rotation through angles up to 360° is shown in B.P. No. 1,358,327.

Figure 1:
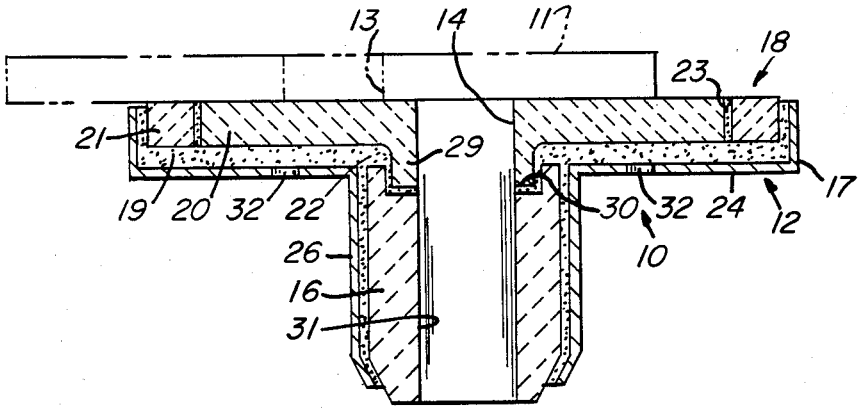
FIG. 1 is a greatly-simplified illustration of the principal parts of a known two-plate sliding gate valve, and shows an improved sliding plate valve member according to the invention.
Figure 2:
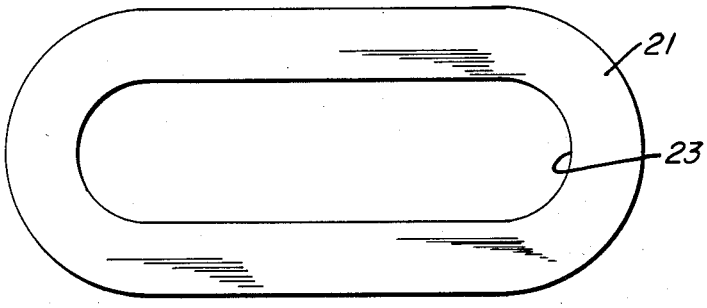
FIG. 2 is a plan view of an outer plate component of the said valve member.
Figure 3:
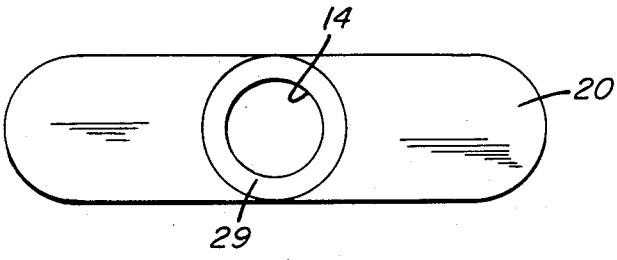
FIG. 3 is a plan view from underneath of an inner plate component of the said valve member.

FIG. 1 of the drawings shows the two principal parts of a linearly-operated two-plate valve 10; the valve housing, framework, means to bias the two plates 11, 12 into liquid-tight, face-to-face contact, and means to move the sliding plate 12 reciprocally are all omitted for similicity. In FIG. 1, plate 11 is the stationary upper plate which is mounted leak-tightly to the teeming opening of a metal pouring vessel such as a ladle. Plate 12 is the reciprocal, slidingly movable plate. Both plates 11 and 12 are orificed, at 13, 14. The valve 10 is shown in a flow-stopping setting with the orifices 13, 14 wholly out of registry.

The sliding plate 12 is an elongated article from which a metal-jacketed nozzle 16 depends. The plate itself comprises a shallow, apertured metal tray 17 (e.g. of steel) having a plate member 18 bedded therein on a layer of refractory cement 19. The plate member is a composite structure including two refractory components 20, 21 which closely interfit one with the other. The first refractory component 20 has the orifice 14 which is juxtaposed or concentric with the aperture 22 in the tray 17. Refractory component 20 is elongated with the orifice 14 disposed centrally therealong. The other refractory component 21 has an opening 23 centrally therein sized and shaped to the plane outline of component 20, whereby the latter is received snugly within the component 21. The component 21 occupies a rather narrow band around the periphery of the tray 17.

The exposed surfaces of the components 20, 21 (which make contact with the stationary upper plate 11) are coplanar and parallel to the base 24 of the tray 17.

As shown in FIG. 1, the metal jacket 26 of pouring nozzle 16 is secured within the tray aperture 22. The jacket 26 and tray 17 can be welded, brazed or otherwise secured together. The nozzle 16 is coupled with the refractory component 20 by a male and female interconnection. This interconnection comprises a downward protrusion 29 of component 20 which extends about the orifice 14, and a recess 30 in the confronting top end of the nozzle 16. The protrusion serves as a liner for the top end of the nozzle and serves to protect the vulnerable top end of the nozzle bore or passage 31 from deterioration by metal flowing through the valve. The transverse shape and size of at least the lower end of the orifice in the protrusion 29 will normally be identical to the shape and size of the nozzle passage 31. As shown, the orifice 14 and passage 31 are circular in cross-section and are of the same diameter throughout.

In its base beneath the refractory component 20, the tray has a plurality of openings 32 for a purpose to be described hereinafter.

The construction of the sliding plate 18 as a composite including two plate members 20, 21 with a separately-formed nozzle body 16 allows different refractories to be chosen the better to exploit their various beneficial properties. The sliding plate 18 can therefore be tailored to the metal to be poured taking account of the particular difficulties expected to be met in practice. Moreover, the composite construction lends itself to cost efficiency exercises. One can, for instance, make the component 20 from an inexpensive refractory concrete and the component 21 from a more expensive fired refractory, and then repeatedly replace component 20. Component 21 need never make contact with molten metal and hence can enjoy an extended life. Component 21 could for this reason be an inexpensive concrete item. Component 20 could be made from an expensive fired refractory if such allows a suitably extended service life to be obtained. The material from which the nozzle 16 is made will be chosen from similar general considerations and may, for instance, comprise a fireclay composition.

In normal use of the valve 10, the plate 18 is reciprocated linearly for opening and closing the valve, between positions where the orifices 13, 14 are in coincidence and are out of registry with orifice 14 to the right of orifice 13. The upper surface of refractory component 20 to the left of orifice 14 will be swept by molten metal in orifice 13 as the plate is reciprocated and thus will gradually deteriorate. Moreover, the junction between the left hand part of the orifice 14 with the said upper surface will wear away during throttling. The useful life of the plate 18 is therefore limited, but can be doubled by turning it end-for-end in the valve 10.

The metal tray 17 and plate component 21 can still be reused, since neither come into contact with molten metal. Renovation of the plate 18 involves removal of plate component 20 and its replacement. To remove component 20, tooling such as a pneumatic or hydraulic ram or similar is used to thrust component 20 out of the tray 17, the tooling being centered on the holes 32 and driven therethrough. After detachment of component 20, any of the associated cement remaining in the tray 17 is chipped out. Then a new component 20 is installed on a bed of fresh cement and is leveled with component 21.

If desired, the tray 17 could have further holes beneath component 21 to ease removal of the latter if it is desired to replace this.

Once component 20 is removed, it is possible to force the nozzle 16 upwardly out of its jacket. The nozzle may be made of a material which enjoys a service life approximately equal to that of the plate component 20, and hence may be replaced routinely with component 20.

The width of the plate component 20 is greater than the width of the track swept by molten metal in orifice 13 as the plate member 18 is reciprocated. By way of example, the plate component 20 can have a width of about 1.4 to 1.5 times the diameter of orifice 13. The plate orifice 14 will be positioned centrally considered widthwise of the plate component 20.

The valve plate 18 is primarily meant for use as the sliding plate of a two-plate valve, or as the stationary lower plate of a three-plate valve. With suitable design of the discharge well area of a metal holding vessel such as a ladle, the same valve plate design may serve for the stationary upper plate of a two or three plate valve.

The invention need not be embodied solely in a bilaterally-symmetrical valve plate as shown and described above. In one modification, the pour passage through the valve plate may be adjacent one end thereof. The elongated plate component 20 will then have its orifice at one end.

The invention is likewise applicable to rotationally operable valves. For a semi-rotary valve (wherein the sliding plate is reciprocated through an arc between opening and closing positions), the valve plate embodying the invention may for instance be segment shaped when viewed in plan. The orificed plate component will be of arcuate form (a segment of an annulus or kidney-shaped) and will have its orifice placed in the middle or at one end thereof. Of course, the shape of the orificed plate component will be determined by the desire that only this component shall be swept by molten metal during operation of the valve.

Some rotary valves offer a choice of pouring passages and nozzles of different flow cross sections. For such valves, plate members equivalent to valve plate 18 are of circular plan form. According to the invention, the construction of the said plate members can utilise a plurality of arcuate, orificed plate components as described in the preceding paragraph. Their orifices will be aligned with corresponding apertures provided in a circular metal tray. In service, some pouring passages may be used more frequently than others. The most heavily used pouring positions will degrade more rapidly than others and the construction will allow selective replacement of their associated orificed plate components. One or more holes 32 will be provided for each arcuate plate component.

In the alternative, the orificed plate component of a circular plate member may take the form of either a circular disc or an annulus having a plurality of orifices therein. A plurality of holes 32 will be provided, under the said component, in the tray. Three or more holes may be found desirable.

The bed of cement 19 is shown exaggerated in thickness in FIG. 1. In practice, the thicknesses of both plate components 20, 21 are approximately equal or comparable to the depth of the tray. The orificed plate component is as thick as the other component 21 except in the region of the orifice. The constructions described herein are particularly well adapted to valve plates whose refractories are produced by the cast concrete technique.

Usually, the concrete 19 will have apertures superposed on the openings 32, so that the tooling can thrust directly on plate component 20 to displace the latter from the tray 17. Where the layer of concrete 19 is thin, however, apertures therein may prove unnecessary.

Alternative arrangements are contemplated. In the foregoing description, it has been intimated that the plate components 20, 21 will be nearly as thick as the depth of the tray, so that the layer of concrete 19 will be thin. For maximum economy, however, it may be preferred to make the concrete layer substantially thicker than at least the plate component 20—if not both components 20, 21—where high cost, highly refractory fired material constitutes the latter component(s). The plate component 20 can, therefore, take the form of a shallow, fired tile having an orifice for metal flow. If the concrete 19 and nozzle 16 are adequately resistant to molten metal, the protrusion 29 of plate component 20 can be omitted.

According to the foregoing description, the components 20 and 21 can be made from fired refractories or refactory concretes as dictated inter alia by cost efficiency exercises. Also as stated the material from which the nozzle 16 is made can be chosen on the basis of similar considerations. Some exemplary alternate combinations are now described in connection with FIGS. 4 through 8.

Figure 4:
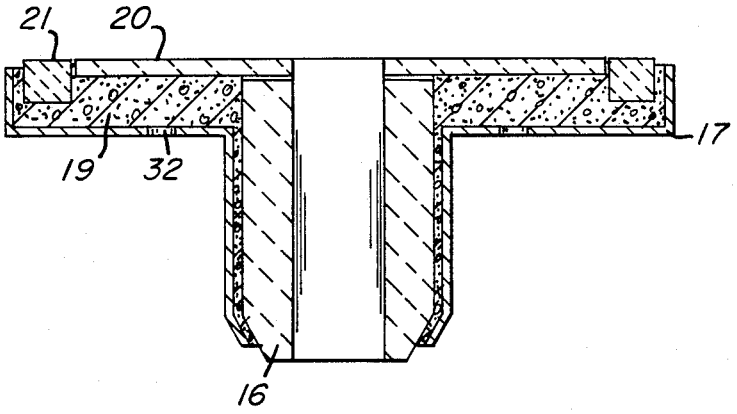
FIGS. 4 through 8 are views, similar to FIG. 1, illustrating alternative forms of the invention.

As shown in FIG. 4, the plate components 20, 21 and nozzle 16 may all be fired refractory bodies, set or bedded in the refractory concrete layer 19. Component 20 can be "tile"-like and appreciably thinner than component 21. The latter can have a thickness nearly as great as the depth of the tray 17. The three fired bodies may have the same or different compositions.

Figure 5:
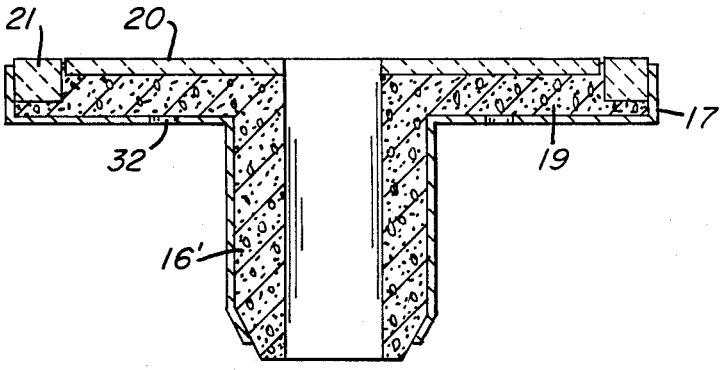
Figure 6:
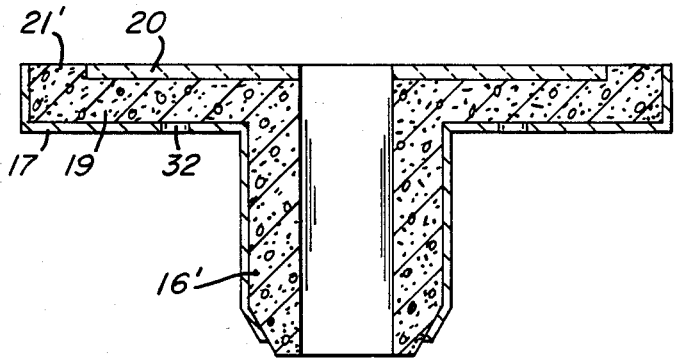
Figure 7:
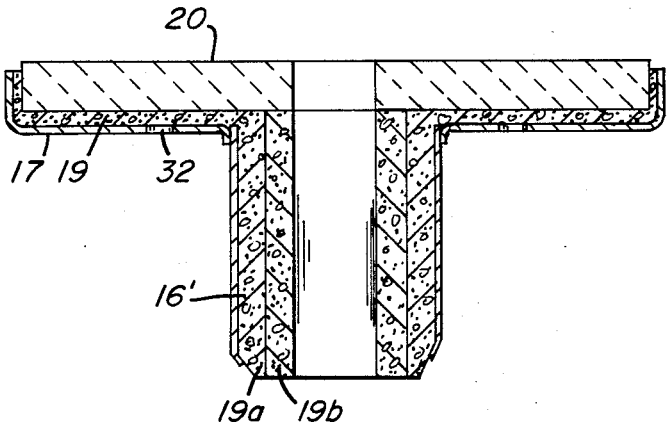

As shown in FIG. 5, the plate components 20, 21 can be as described in (1) above, while the nozzle 16' is a refractory concrete body. The nozzle concrete can be the same as the concrete of layer 19 and the said nozzle and layer can be formed as a monolithic or unitary moulding.

Plate component 20 (FIG. 6) can be a fired body, e.g. a "tile" while component 21', nozzle 16 and layer 19 are all made of refractory concrete. The same concrete could form these three elements and they could be formed integral with one another as a monolithic or unitary moulding.

In a structure similar to that just described in (3) above, the concrete moulding comprising component 21, layer 19 and nozzle 16' is composed of higher and lower duty concrete formulations. The higher duty formulation (which is more resistant to molten metal) forms an inner sleeve or skin about the area exposed to molten metal, which includes the nozzle bore. The nozzle element is therefore a composite concrete structure indicated as **19*a* and 19*b* in FIG. 7**. The inner sleeve or skin can extend along the whole length or a major part of the length of the bore.

Similarly, the structure described in (2) above can be likewise composed: layer 19 and the outer part of the nozzle wall are composed of lower duty concrete while the area exposed to molten metal, including the inner part of the nozzle wall, is a higher duty concrete.

Figure 8:
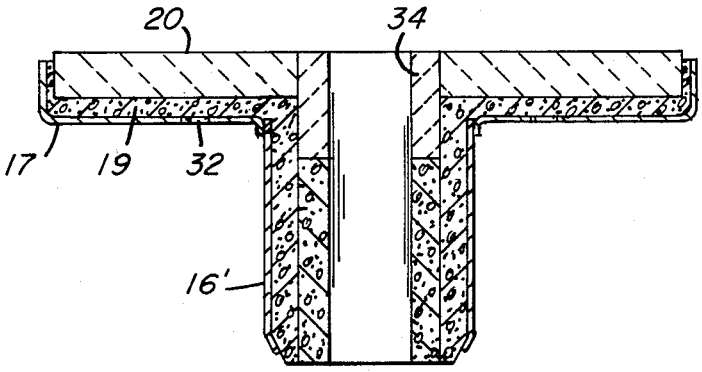

From a cost and manufacturing standpoint, a plate component 20 in the form of a thin, flat tile without any protrusion such as that indicated as 29 in FIG. 1 is attractive. As shown in FIG. 8, such a flat component 20 can be assembled with a fired refractory sleeve 34 where the concrete layer 19 must at all costs be isolated from molten metal. The sleeve 34 may be located beneath and abutting the component 20 if its inner diameter equals the plate orifice diameter. Alternatively as shown in the drawing, the sleeve could extend through the plate orifice and end flush with the top surface thereof. The fired sleeve could be extended from the plate top surface so as to define at least an upstream part of the nozzle bore wall.

What is claimed is:

1. A valve plate assembly adapted for positioning in a mounting receptacle of a sliding gate valve for teeming molten metal, said assembly including a refractory portion having oppositely spaced, substantially parallel surfaces, one of which is a slide surface for engagement with the slide surface of a cooperating valve component, a teeming orifice extending transversely through said refractory portion and a metal casing enclosing substantially all but the slide surface of said refractory portion and having a teeming opening axially aligned and communicating with said refractory portion teeming orifice, the improvement comprising:

(a) said refractory portion being a composite structure including first and second refractory members each having one of their surfaces disposed in mutual coplanar relation to form the sliding surface of said refractory portion;

(b) said first refractory member being a fired refractory insert containing said teeming orifice and being surrounded by and detachably inset in a receiving opening in said second refractory member; and (c) said metal casing containing at least one hole laterally spaced from said teeming opening and positioned subjacent to and within the peripheral boundary of said first refractory member to receive tooling for impacting said first refractory member to detach the same from said valve plate assembly.

2. A valve plate assembly according to claim 1 in which said second refractory member is a fired refractory member, said first and second refractory members being embedded in a body of cementitious refractory material within said metal enclosure.

3. A valve plate assembly according to claim 1 in which said second refractory member is a molded refractory concrete.

4. A method of renovating a valve plate assembly for use in a sliding gate valve for teeming molten metal, said assembly comprising a composite refractory structure mounted within a metal casing and including a first refractory member in the form of a fired refractory insert containing a molten metal teeming orifice and a second refractory member surrounding at least the peripheral sides of said first refractory member, and said metal casing including a bottom portion containing a first opening in axial alignment with the teeming orifice in said first refractory member and at least one tool-receiving hole laterally spaced from said first opening and subjacent said first refractory member, comprising the steps of:

(a) inserting a member-detaching tool within said tool-receiving opening;
(b) applying an axial force to said tool sufficient to penetrate said assembly for impacting and detaching said first refractory member from said second refractory member;
(c) inserting a replacement insert of like physical configuration into the resultant opening in said second refractory member; and
(d) fixing said replacement insert therein.

* * * * *